US005725144A

United States Patent [19]

Stone et al.

[11] Patent Number: 5,725,144

[45] Date of Patent: Mar. 10, 1998

[54] COLLAPSIBLE PAPERBOARD CARTON

[75] Inventors: James L. Stone, Grand Rapids, Mich.; Timothy P. Burda, Cincinnati, Ohio

[73] Assignee: Tenneco Packaging, Evanston, Ill.

[21] Appl. No.: 690,453

[22] Filed: Jun. 26, 1996

[51] Int. Cl.[6] ..... B65D 5/355

[52] U.S. Cl. ..... 229/101; 229/103.2; 229/104

[58] Field of Search ..... 229/101, 103.2, 229/104; 206/494, 526, 499, 170, 175, 427; 53/436, 526, 462, 458

[56] References Cited

U.S. PATENT DOCUMENTS

| | | | |
|---|---|---|---|
| 3,172,563 | 3/1965 | Harwood | 206/494 X |
| 3,198,420 | 8/1965 | Hiersteines | 229/101 X |
| 3,199,764 | 8/1965 | Oliver et al. | 229/104 |
| 3,249,283 | 5/1966 | Craddock et al. | 229/101 |
| 3,322,264 | 5/1967 | McNair et al. | 229/101 X |
| 3,727,827 | 4/1973 | Stice | 229/101 |
| 4,482,090 | 11/1984 | Milliens | 206/427 |
| 5,014,905 | 5/1991 | Cassidy | 229/113 |
| 5,054,644 | 10/1991 | Greenslade | 229/154 X |
| 5,154,343 | 10/1992 | Stone | 229/225 |
| 5,161,734 | 11/1992 | Ruehl et al. | 229/227 |
| 5,170,934 | 12/1992 | Lemoine | 229/101 |
| 5,236,123 | 8/1993 | Stone et al. | 229/225 |
| 5,265,799 | 11/1993 | Stone | 229/225 |
| 5,314,114 | 5/1994 | Stone | 229/225 |
| 5,373,960 | 12/1994 | Gunn et al. | 220/416 |
| 5,439,133 | 8/1995 | Stone | 220/418 |
| 5,624,031 | 4/1997 | Fowler et al. | 229/101 X |

*Primary Examiner*—Gary E. Elkins
*Attorney, Agent, or Firm*—Arnold, White & Durkee

[57] ABSTRACT

A collapsible carton comprises opposing front and back panels, opposing top and bottom panels generally bridging said opposing front and back panels, a first pair of accordion panels connecting said front panel to said bottom panel, and a second pair of accordion panels connecting said back panel to said bottom panel. The carton further includes a plurality of side closure flaps extending from opposing ends of the top and bottom panels and the front and back panels. When the carton is in open-sided form and after a compressible product is loaded into the carton through one of the open sides, the carton is collapsed in response to moving the top and bottom panels toward each other so as to cause the first and second pairs of accordion panels to spread outward in accordion-like fashion into overlapping relationship.

9 Claims, 5 Drawing Sheets

COLLAPSIBLE PAPERBOARD CARTON

FIELD OF THE INVENTION

The present invention relates generally to paperboard cartons and, more particularly, to a collapsible paperboard carton for holding compressible products so as to minimize the space occupied by the carton during shipping, handling, and subsequent shelf display.

BACKGROUND OF THE INVENTION

The space available for shipping and handling paperboard cartons and subsequently displaying the cartons on store shelves is limited. Therefore, it is desirable to package products in cartons which are sufficiently large to effectively contain the product and yet sufficiently small to prevent waste of valuable and costly space. When the contained product is compressible, i.e. can be reduced in size, the product can be loaded into a smaller carton by compressing the product prior to loading it into the carton. While the use of the smaller carton conserves the amount of space occupied by the carton, some products such as diapers or protective pads can become distorted or unevenly stacked if they are compressed prior to being loaded into the carton. A need therefore exists for a paperboard carton which can effectively contain compressible products and yet is sufficiently small to prevent waste of valuable and costly space.

SUMMARY OF THE INVENTION

A collapsible carton embodying the present invention comprises opposing front and back panels, opposing top and bottom panels generally bridging said opposing front and back panels, a first pair of accordion panels connecting said front panel to said bottom panel, and a second pair of accordion panels connecting said back panel to said bottom panel. The carton further includes a plurality of side closure flaps extending from opposing ends of the top and bottom panels and the front and back panels. When the carton is in open-sided form and after loading a compressible product into the carton through one of the open sides, the carton is collapsed in response to moving the top and bottom panels toward each other so as to cause the first and second pairs of accordion panels to spread outward in accordion-like fashion into overlapping relationship.

BRIEF DESCRIPTION OF THE DRAWINGS

Other objects and advantages of the invention will become apparent upon reading the following detailed description and upon reference to the drawings in which.

Figure 1:
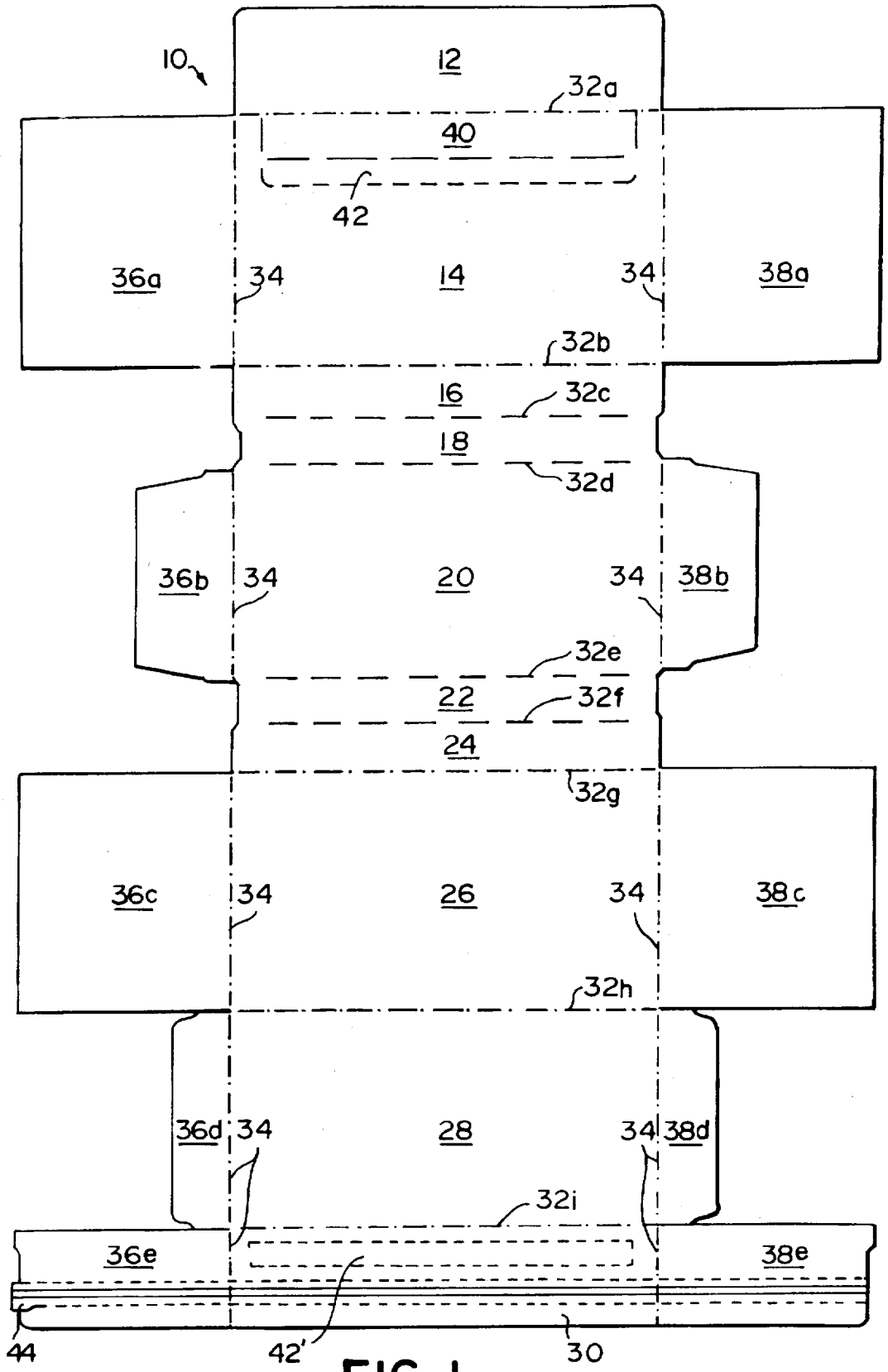
FIG. 1 is a plan view of an inside surface of a paperboard blank used to form a collapsible paperboard carton embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings, FIG. 1 is a plan view of an inside surface of a unitary paperboard blank 10 used to form a collapsible paperboard carton embodying the present invention. The blank 10 includes a plurality of panels and flaps hingedly connected about horizontal and vertical fold lines. Specifically, the blank 10 includes ten vertically aligned, substantially rectangular panels 12, 14, 16, 18, 20, 22, 24, 26, 28, and 30 hingedly connected along horizontal fold lines 32*a–i* which facilitate folding of the carton panels relative to each other. The panels 14, 20, 26, 28, and 30 are main body panels which respectively form the inner front panel, bottom panel, back panel, top panel, and outer front panel of the collapsible carton embodying the present invention. The panel 12 is an overhanging panel which forms part of an optional reclosure feature incorporated in the collapsible carton. As described below in connection with the formation of the blank into the carton, the carton-collapsing accordion panels 16, 18, 22, and 24 permit the carton to be reduced in height after the blank 10 has been folded into an open-sided configuration and loaded with a compressible product.

A pair of opposing side closure flaps is hingedly connected to each of the five main body panels 14, 20, 26, 28, and 30 along vertical fold lines 34. More specifically, third-in closure flaps 36*a* and 38*a* are associated with the inner front panel 14; first-in closure flaps 36*b* and 38*b* are associated with the bottom panel 20; second-in closure flaps 36*c* and 38*c* are associated with the back panel 26; fourth-in closure flaps 36*d* and 38*d* are associated with the top panel 28; and third-in closure flaps 36*e* and 38*e* are associated with the outer front panel 30. As described below, the panels 36*a–e* and 38*a–e* form the respective side walls of the paperboard carton manufactured from the blank 10. An integral tear strip 44 extends across the closure flaps 36*e* and 38*e* and the outer front panel 30.

Figure 2:
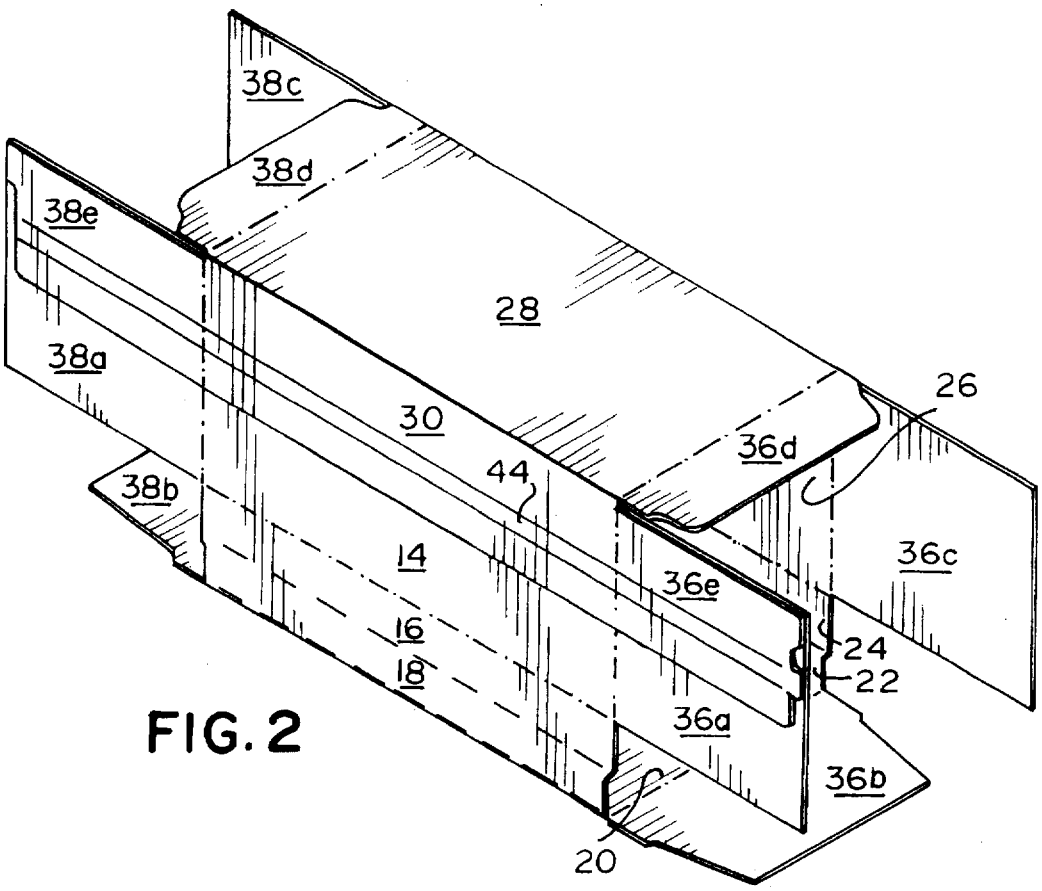
FIG. 2 is a perspective view of an open-sided carton formed from the blank in FIG. 1.
Figure 3:
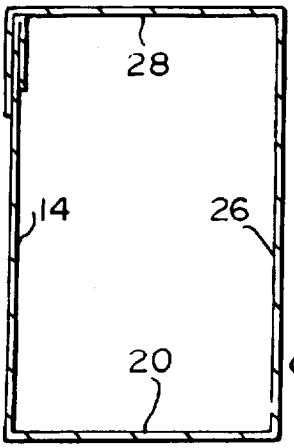
FIGS. 3, 4, and 5 are cross-sectional views of the open-sided carton showing the process of collapsing the carton to reduce the height thereof.

To achieve the open-sided carton configuration in FIG. 2, the overhanging panel 12 is folded inward about the fold line 32*a* approximately 180 degrees relative to the inner from panel 14, and the inner peripheral surface of the overhanging panel 12 is adhered to the inner surface of the inner front panel 14. A hinged flap 40 and a die-cut island portion 42, which form part of the aforementioned optional reclosure feature, remain free of adhesive. Next, the blank 10 is folded and glued to form an open-sided, generally rectangular carton by successively folding each of the five main body panels 14, 20, 26, 28, and 30 about the fold lines 32*d*, 32*e*, 32*h*, and 32*i* to the extent of 90 degrees such that the outer front panel 30 is effectively positioned with its inner surface against the outer surface of the inner front panel 14. At this point, the outer surface of the island portion 42, but not the hinged flap 40, is adhered to the inner surface of the outer from panel 30 above the tear strip 44 at a location designated by the reference numeral 42' in FIG. 1. Also, the portion of the inner surface of the outer front panel 30 below the tear strip 44 is adhered to the outer surface of the inner front panel 14, and the portions of the inner surfaces of the closure flaps 36*e* and 38*e* below the tear strip 44 are adhered to the outer surfaces of the respective closure flaps 36*a* and 38*a*.

Figure 4:
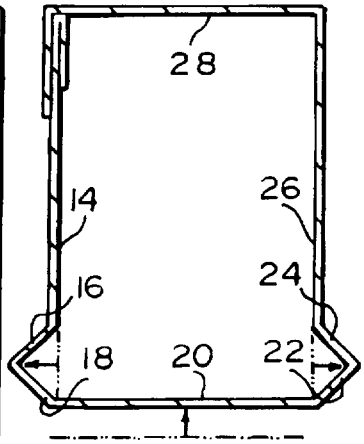
Figure 5:
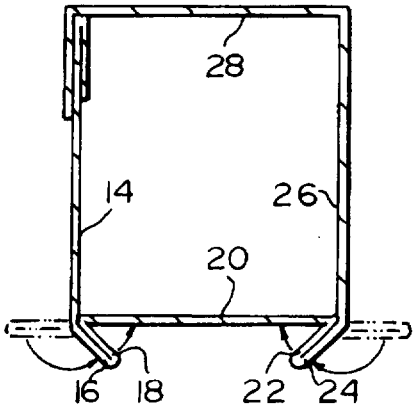
Figure 6:
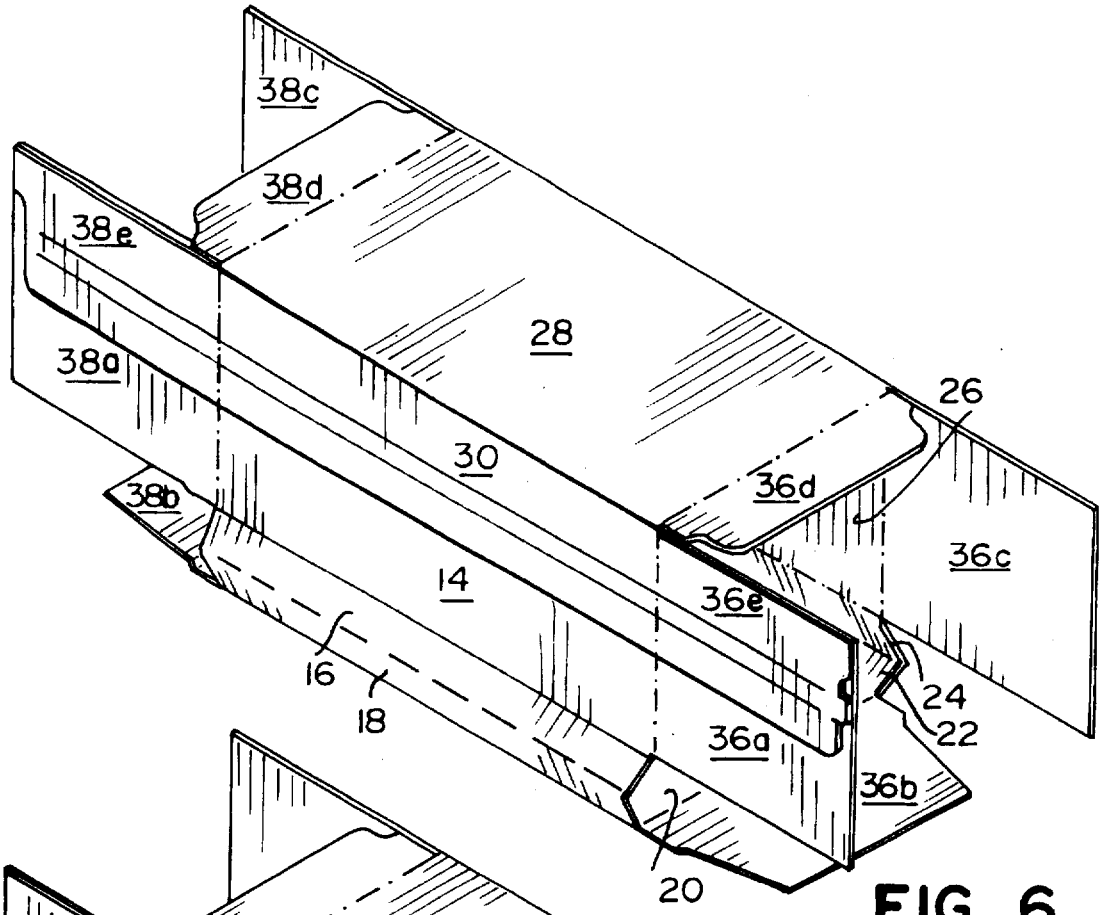
FIGS. 6 and 7 are perspective views of the open-sided carton showing the process of collapsing the carton to reduce the height thereof.
Figure 7:
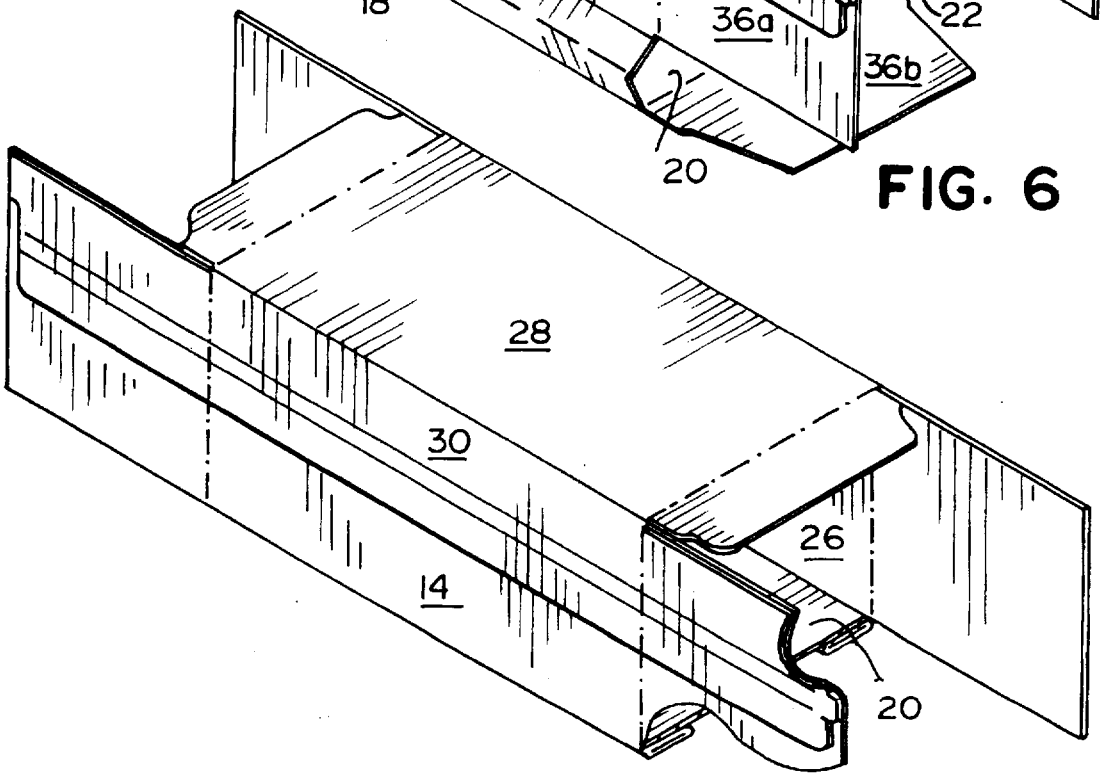
Figure 9:
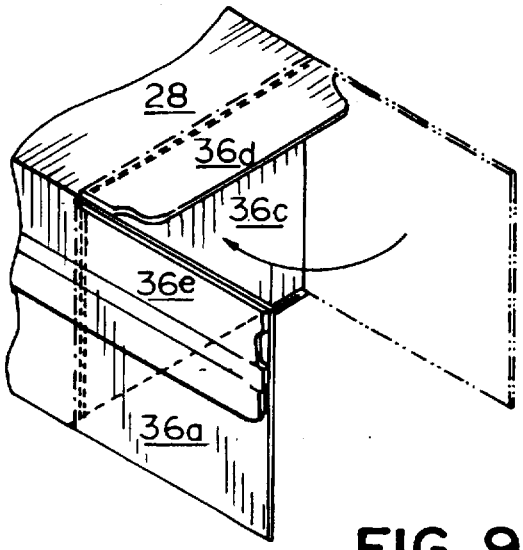
FIGS. 8, 9, 10, and 11 are perspective views of an end portion of the collapsed carton showing one possible sequence of folding side flaps to form one side wall of the carton.
Figure 8:
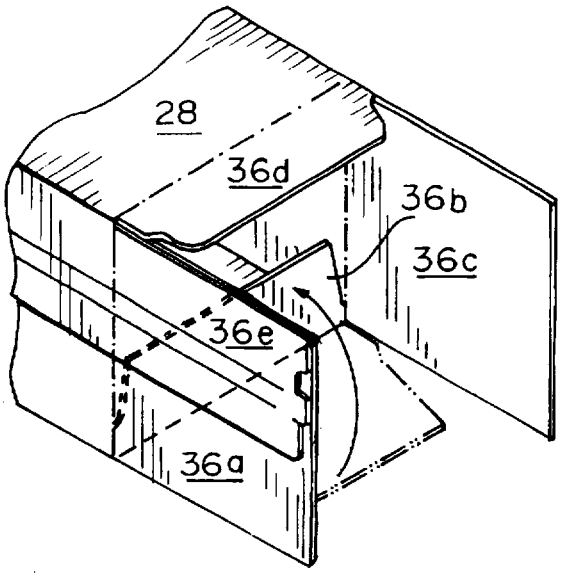
Figure 10:
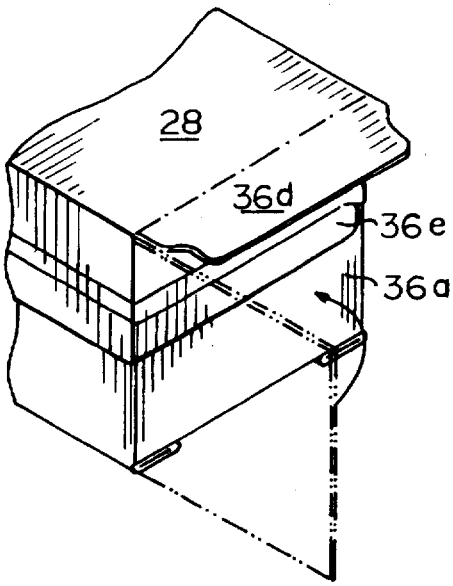
Figure 11:
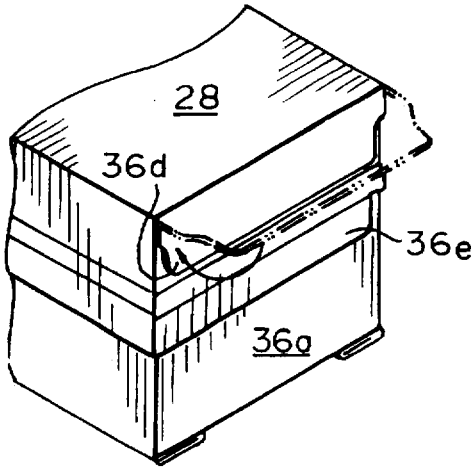

After folding the blank 10 into the open-sided carton in FIG. 2, a compressible product is loaded into the open-sided carton through one of the two open sides. The open-sided carton is then collapsed as shown in FIGS. 3–7 to reduce the height thereof. More specifically, the bottom panel 20 is forced upward as shown in FIGS. 4 and 6 to cause the carton-collapsing panels 16 and 18 and the carton-collapsing panels 22 and 24 to spread outward in accordion-like fashion into overlapping relationship. The compressible product disposed within the open-sided carton is compressed by the top and bottom panels 28 and 20, which approach each other as the carton-collapsing panels 16, 18, 22, and 24 are spread outward. Since the compressible product is loaded into the open-sided carton prior to reducing its height, the product does not become distorted or unevenly stacked in response to collapsing the open-sided carton. Rather, the approaching top and bottom panels 28 and 20 evenly compress the compressible product. As shown in FIGS. 5 and 7, the overlapping panels 16 and 18 and the overlapping panels 22 and 24 are then folded inward approximately 180 degrees, and the outer surfaces of the carton-collapsing panels 18 and 22 are adhered to the outer surface of the bottom panel 20. The resulting open-sided carton in FIG. 7 has a reduced height as compared to the open-sided carton in FIG. 2.

Referring to FIGS. 8–11, the open-sided carton is sealed by folding the side closure flaps. To seal the side formed from the closure flaps 36*a–e*, the closure flaps 36*a–e* are successively folded inward by approximately 90 degrees in the following exemplary sequence: closure flap 36*b* (FIG. 8), closure flap 36*c* (FIG. 9), attached closure flaps 36*a* and 36*e* (FIG. 10), and closure flap 36*d*. Other folding sequences are possible. When the closure flap 36*a* is folded onto the closure flap 36*c* (FIG. 10), the inner surface of the closure flap 36*a* is adhered to the outer surface of the closure flap 36*c*. Likewise, when the closure flap 36*d* is folded onto the closure flap 36*e* (FIG. 11), the inner surface of the closure flap 36*d* is adhered to the outer surface of the closure flap 36*e*. The opposing side formed from the closure flaps 38*a–e* is sealed in similar fashion.

Figure 12:
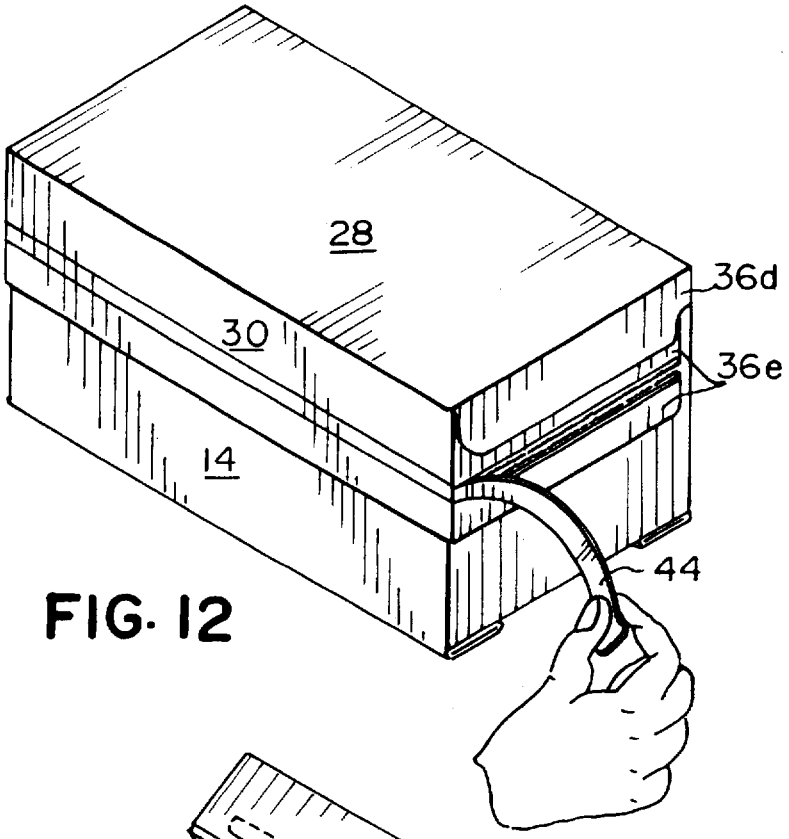
FIG. 12 is a perspective view of the carton in sealed form with a tear strip partially removed.
Figure 13:
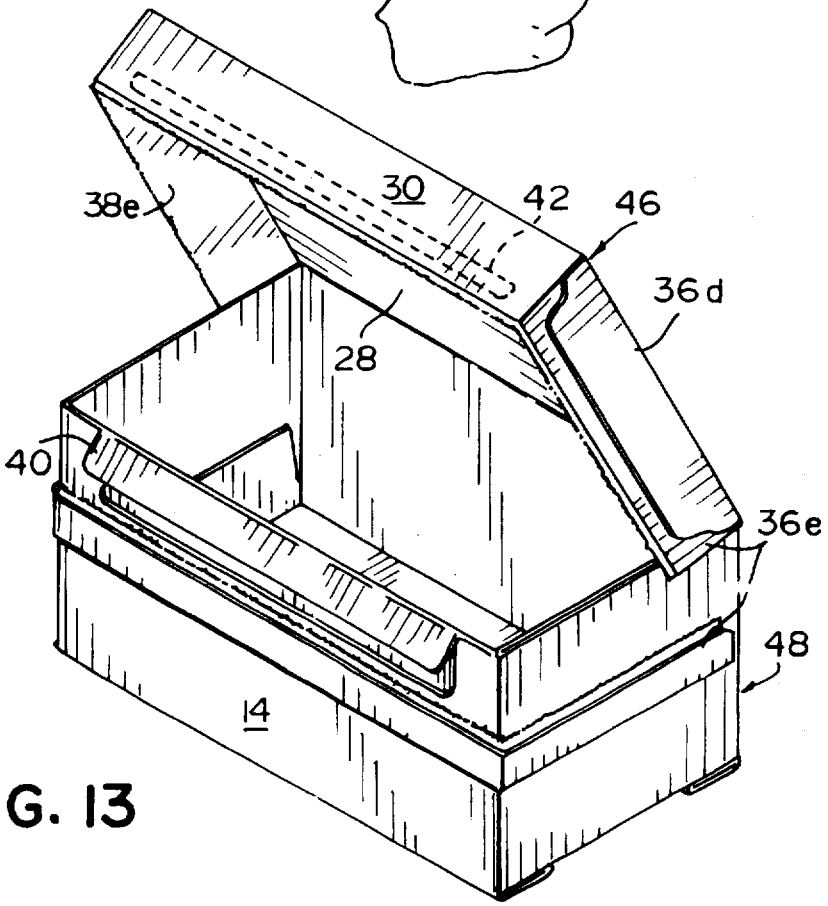
FIG. 13 is a perspective view of the carton in opened form with the tear strip completely removed.

The collapsed and sealed carton is illustrated in FIG. 12. The carton is opened by removing the tear strip 44 which integrally extends across the outer front panel 30 and the closure flaps 36*e* and 38*e*. Removal of the tear strip 44 divides each of the outer front panel 30 and the closure flaps 36*e* and 38*e* into two sections, with the upper sections of the outer front panel 30 and the closure flaps 36*e* and 38*e* forming three sides of a lid 46 (FIG. 13). The closure flaps 36*d* and 38*d*, which are attached to the respective closure flaps 36*e* and 38*e*, also form parts of opposing sides of the lid 46. When the lid 46 is raised upwardly from a base 48, as shown in FIG. 13, the compression force on the compressed product within the carton is released, thereby allowing the compressed product to decompress. If the carton is provided with the optional reclosure feature, the island portion 42 breaks away from its nicked connection to the hinged flap 40 and remains attached to the inner surface of the upper section of the outer front panel 30. As stated above, the upper section of the outer front panel 30 forms one side (front) of the lid 46. When the carton is reclosed by pushing the lid back down to its original position, the top panel 28 recompresses the compressible product remaining within the carton if the compressible product has a height greater than the distance between the top and bottom panels 28 and 20 of the closed carton. The lid 46 is retained in the closed position by virtue of a snapped engagement of the island portion 42 with the hinged flap 40. The reclosure feature is advantageous in that it insures that the lid 46 will remain in the closed position and will not be forced open by virtue of any upward force asserted by the compressible product against the lid 46. Further information concerning the structure and operation of the optional reclosure feature created from the overhanging panel 12, the hinged flap 40, and the island portion 42 may be obtained from U.S. Pat. No. 5,154,343 to Stone, which is incorporated herein by reference.

While the present invention has been described with reference to one or more particular embodiments, those skilled in the art will recognize that many changes may be made thereto without departing from the spirit and scope of the present invention. Each of these embodiments and obvious variations thereof is contemplated as failing within the spirit and scope of the claimed invention, which is set forth in the following claims.

What is claimed is:

1. A collapsible carton, comprising:

opposing front and back panels;

opposing top and bottom panels generally bridging said opposing front and back panels and being separated by an unobstructed gap;

a first pair of accordion panels connecting said front panel to said bottom panel, said first pair of accordion panels overlapping and abutting each other and being directly adhered to a first adjacent portion of said carton; and a second pair of accordion panels connecting said back panel to said bottom panel, said second pair of accordion panels overlapping and abutting each other and being directly adhered to a second adjacent portion of said carton, said unobstructed gap being reduced in response to said first pair of accordion panels being overlapped and said second pair of accordion panels being overlapped.

2. The carton of claim 1, wherein said from panel includes upper and lower front panel edges and said back panel includes upper and lower back panel edges, said top panel extending between said upper front panel edge and said upper back panel edge, said first pair of accordion panels connecting said lower front panel edge to said bottom panel, said second pair of accordion panels connecting said lower back panel edge to said bottom panel.

3. The carton of claim 2, wherein said bottom panel is spaced from said lower front panel edge and said lower back panel edge prior to collapsing said carton, and wherein said bottom panel is immediately adjacent to said lower front panel edge and said lower back panel edge in response to collapsing said carton.

4. The carton of claim 3, wherein said opposing front and back panels and said opposing top and bottom panels define an interior of said collapsed carton, and wherein said overlapped first pair of accordion panels and said overlapped second pair of accordion panels are disposed outside said interior.

5. The carton of claim 1, further including first and second sets of side closure flaps extending from opposing ends of said front and back panels and said top and bottom panels.

6. The carton of claim 1, wherein said carton has a height defined by a distance between said top and bottom panels, and wherein said height is reduced in response to collapsing said carton.

7. The carton of claim 6, wherein said first pair of accordion panels are overlapped and said second pair of accordion panels are overlapped in response to relative movement of said top and bottom panels toward each other.

8. The carton of claim 7, wherein said first and second pairs of accordion panels are spread away from each other in response to the relative movement of said top and bottom panels toward each other.

9. A collapsible carton, comprising:

opposing front and back panels;

opposing top and bottom panels generally bridging said opposing front and back panels and being separated by an unobstructed gap; and accordion means for reducing said unobstructed gap separating said top and bottom panels, said accordion means including linked pairs of accordion panels connecting said bottom panel to said front and back panels, the accordion panels of each linked pair overlapping and abutting each other and being directly adhered to a respective adjacent portion of said carton to reduce said unobstructed gap.

* * * * *